US005176762A

United States Patent [19]

Berczik

[11] Patent Number: 5,176,762

[45] Date of Patent: Jan. 5, 1993

[54] AGE HARDENABLE BETA TITANIUM ALLOY

[75] Inventor: Douglas M. Berczik, Palm Beach, Fla.

[73] Assignee: United Technologies Corporation, Hartford, Conn.

[21] Appl. No.: 948,390

[22] Filed: Dec. 23, 1986

Related U.S. Application Data

[63] Continuation-in-part of Ser. No. 815,606, Jan. 2, 1986, abandoned.

[51] Int. Cl.[5] ..... G22C 14/00; G22C 33/00

[52] U.S. Cl. ..... 148/407; 148/421; 148/472; 420/421; 420/583; 420/588

[58] Field of Search ..... 420/421, 583, 588; 148/407, 421, 442

[56] References Cited

U.S. PATENT DOCUMENTS

| | | | |
|---|---|---|---|
| 3,131,059 | 4/1964 | Kaarlela | 420/421 |
| 3,156,590 | 11/1964 | Vordahl | 148/407 |
| 3,444,009 | 5/1969 | Evans et al. | 148/407 |
| 3,644,153 | 2/1972 | Rausch et al. | 148/31.5 |
| 3,673,038 | 6/1972 | Canonico et al. | 29/195 |
| 3,901,743 | 8/1975 | Sprague et al. | 148/133 |
| 3,986,868 | 10/1976 | Crossley | 148/32 |
| 4,040,129 | 8/1977 | Steinemann et al. | 420/421 |
| 4,197,643 | 4/1980 | Burstone et al. | 148/407 |
| 4,422,887 | 12/1983 | Neal et al. | 198/133 |
| 4,512,826 | 4/1985 | Whang | 148/407 |

FOREIGN PATENT DOCUMENTS 1175683 12/1969 United Kingdom .

OTHER PUBLICATIONS

F. H. Froes and H. B. Bomberger, "The Beta Titanium Alloys", *Journal of Metals*, pp. 28-37, Jul. 1985.

"Direct Brazing of Ceramics, Graphite, and Refractory Metals"; Canonico et al; *Oak Ridge National Laboratory Report* No. ORNL/TM-5195 (Mar. 1976).

"Ferrous Metals", *Chemical Abstract*, vol. 78, 1973, 32885u, p. 191.

"Nonferrous Metals", *Chemical Abstract*, vol. 85, 1976, 85:181219b, p. 237.

*Primary Examiner*—Peter A. Nelson

*Attorney, Agent, or Firm*—Charles E. Sohl

[57] ABSTRACT

A beta titanium alloy having exceptional high temperature strength properties in combination with an essential lack of combustibility is described. In its basic form the alloy contains chromium, vanadium and titanium the nominal composition of the basic alloy being defined by three points on the ternary titanium-vanadium-chromium phase diagram: Ti-22V-13Cr, Ti-22V-36Cr, and Ti-40V-13% Cr. The alloys of the invention are comprised of the beta phase under all the temperature conditions, have strengths much in excess of the prior art high strength alloys in combination with excellent creep properties, and are nonburning under conditions encountered in gas turbine engine compressor sections.

3 Claims, 5 Drawing Sheets

YIELD STRENGTH
35V-15Cr-1Si Solution Treat
35V-15Cr-1Si Solution Treat & Age
35V-15Cr Solution Treat & Age
35V-15Cr Solution Treat
180
160
140
120
100
80
60
KSI
0
400
800
1200
°F ULTIMATE TENSILE STRENGTH
35V-15Cr-1Si Solution Treat & Age
35V-15Cr-1Si Solution Trea
35V-15Cr Solution Treat & Age
35V-15Cr Solution Treat
200
180
160
140
120
100
80
KSI
0
400
800
1200
°F

ELONGATION

AGE HARDENABLE BETA TITANIUM ALLOY

TECHNICAL FIELD

This invention relates to high strength titanium alloys and particularly to nonburning beta titanium alloys containing substantial amounts of vanadium and chromium.

BACKGROUND ART

Pure titanium exists in the alpha crystalline form at room temperature but transforms to the beta crystalline form at temperatures greater than 1621° F. Various alloying elements increase the stability of the beta phase at lower temperatures. Certain known titanium alloys contain sufficient amounts of the beta phase stabilizers so that they are largely beta phase under most temperature conditions and are referred to as beta titanium alloys. However this class of such alloys are not 100% beta phase but include some amounts of the alpha phase which acts as a strengthening phase but which disappears with increasing temperature, leading to a pronounced in strength at elevated temperatures. The subject of these prior "beta" titanium alloys is discussed in "The Beta Titanium Alloys" by F. H. Froes et al, *Journal of Metals* 1985 pp. 28-37. I know of no commercial titanium alloys which are true 100% beta phase alloys under all conditions of temperature.

Titanium alloys posses an ideal combination of strength and low density for many aerospace applications including gas turbine engines and particularly gas turbine engine compressor blades, vanes and related hardware. However, titanium is a highly reactive metal and can undergo sustained combustion under conditions encountered in gas turbine engine compressors. In such compressors ambient air is compressed to pressures on the order of 850° F. at pressures which may be on the order of 400 psi and can flow at 450 feet per second as it passes through the compressor. Under these conditions commercial titanium alloys will burn uncontrollably if ignited. Ignition can occur by friction arising from the ingestion of foreign objects or as a result of mechanical failure which causes contact between moving and stationary titanium blade objects. Friction between titanium components is particularly troublesome. Such combustion is a great concern to gas turbine engine designers who have gone to great lengths to guard against rubbing between titanium components. However, it has to date been inherent physical characteristic of the titanium alloys used and an unavoidable potential consequence of using titanium in turbine compressor sections.

The assignee of the present invention has long standing expertise in the field of gas turbine engine technology and has devised a test for titanium alloy combustibility which comprises preparing a sample of 0.070 in sheet having a knife edge and placing this knife edge sample in an air stream flowing at 450 feet per second at a pressure of 400 psi and a temperature 850° F. and attempting to ignite the sample using a 200 watt $CO_2$ laser which impinges directly on the knife edge of the sample within the flowing gas stream. These test conditions are typical of those encountered in operating conditions in turbine engines. This test will be used hereinafter to define whether or not an alloy is burnable.

British Patent No. 1,175,683 to Imperial Metal Industries describes a titanium alloy which can contain 25-40% vanadium, 5-15% chromium up 10% aluminum balance titanium. Of 16 specific alloy compositions discussed in the patent only one contains more than 10% chromium and there is no appreciation shown in the patent for the effect of chromium on burnability of titanium alloys. U.S. Pat. No. 3,644,153 describes abrasion resistant materials formed by nitriding titanium alloy substrates. The substrate alloy may contain substantial amounts of vanadium and chromium. There is no disclosure in the patent of any mechanical properties in the substrate material per se nor of any nonburning properties in the substrate nor indeed of any substrate utility aside from as a material to be nitrided. U.S. Pat. No. 3,673,038 deals with a braze material for joining graphite and refractory materials. The braze material can consist of 10-45% vanadium, 5-20% chromium. Chromium is disclosed as providing flowability of the brazed material but no discussion presented concerning burnability.

DISCLOSURE OF INVENTION

A new class of true beta titanium alloys is disclosed based on ternary compositions of titanium-vanadium-chromium which occur in the titanium-vanadium-chromium phase diagram bounded by the points Ti-22V-13Cr, Ti-22V-36Cr, and Ti-40V-13Cr, other more preferred compositions are also defined (all percent figures herein are weight percent unless otherwise noted). The invention alloys have creep strength which are greater than those exhibited by the strongest commerical alloys (i.e. Ti-6-2-4-2) at elevated temperatures and are nonburning under conditions typical of those encountered in gas turbine engine compressor applications. A variety of quaternary (and higher) alloying elements may be added to the basic composition to modify the alloy properties.

The foregoing, and other features and advantages of the present invention, will become more apparent from the following description and accompanying drawings.

BEST MODE FOR CARRYING OUT THE INVENTION

Figure 1:
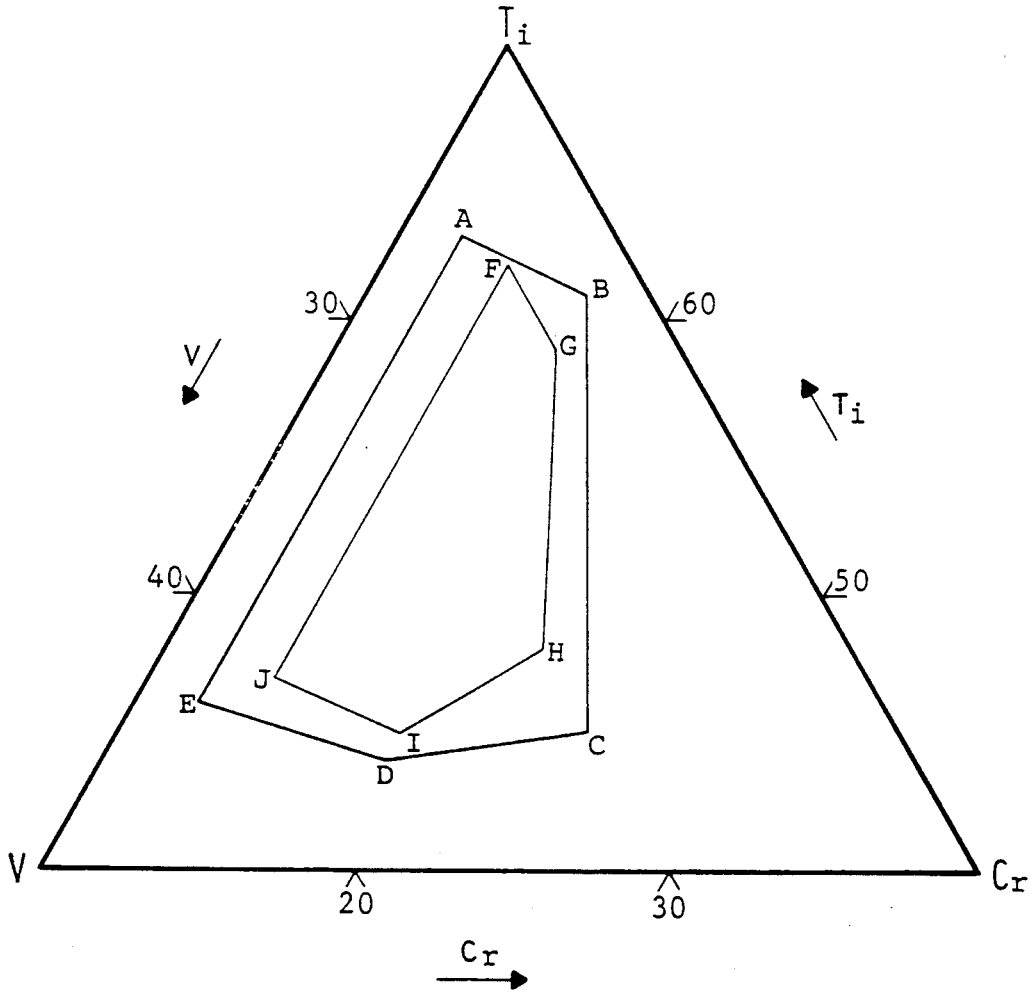
FIG. 1 is a 600° F. ternary diagram of the titanium, vanadium, chromium system.
Figure 2:
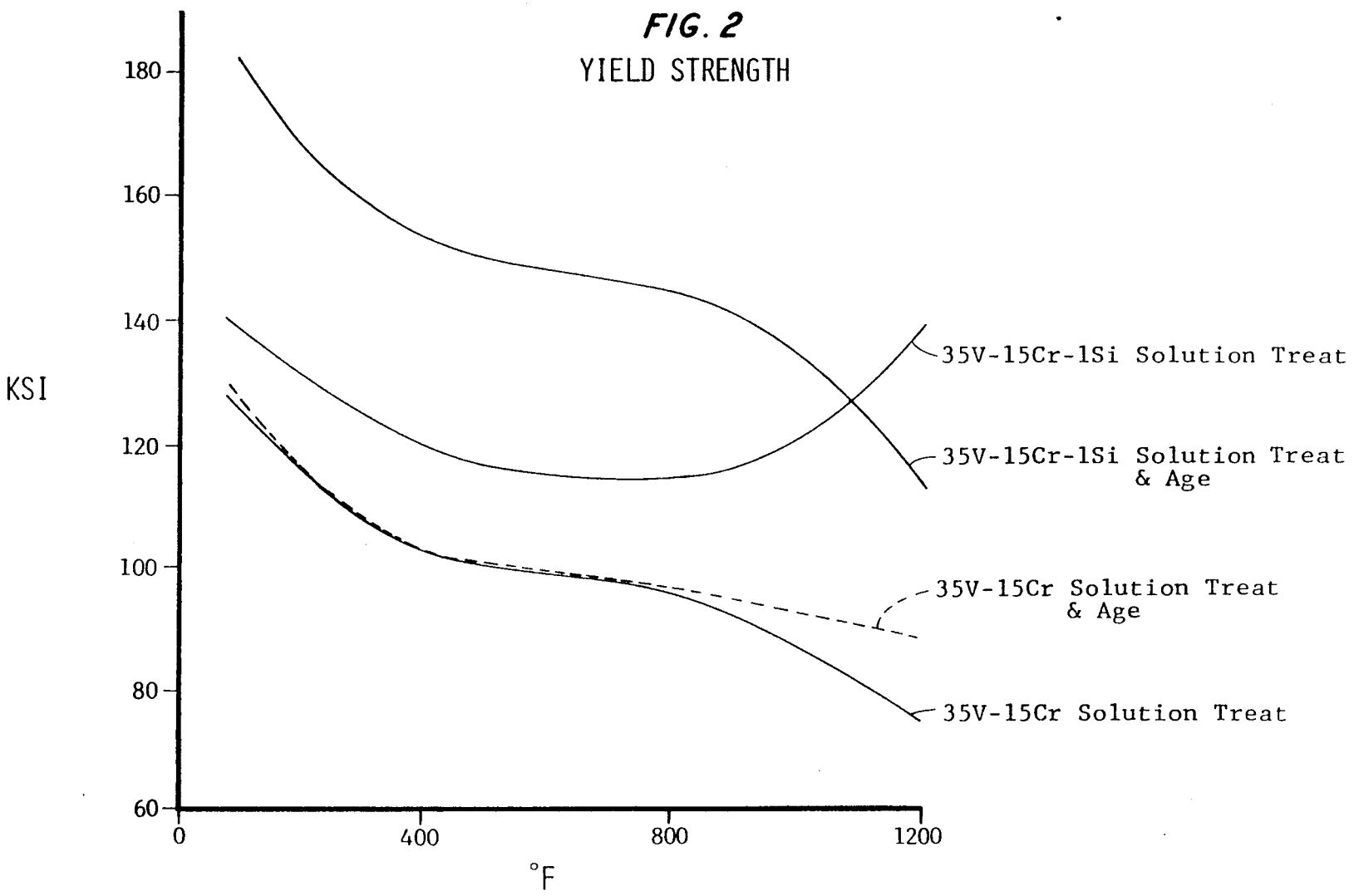
FIG. 2 is an 1100° F. ternary diagram of the Ti-V-Cr system.
Figure 3:
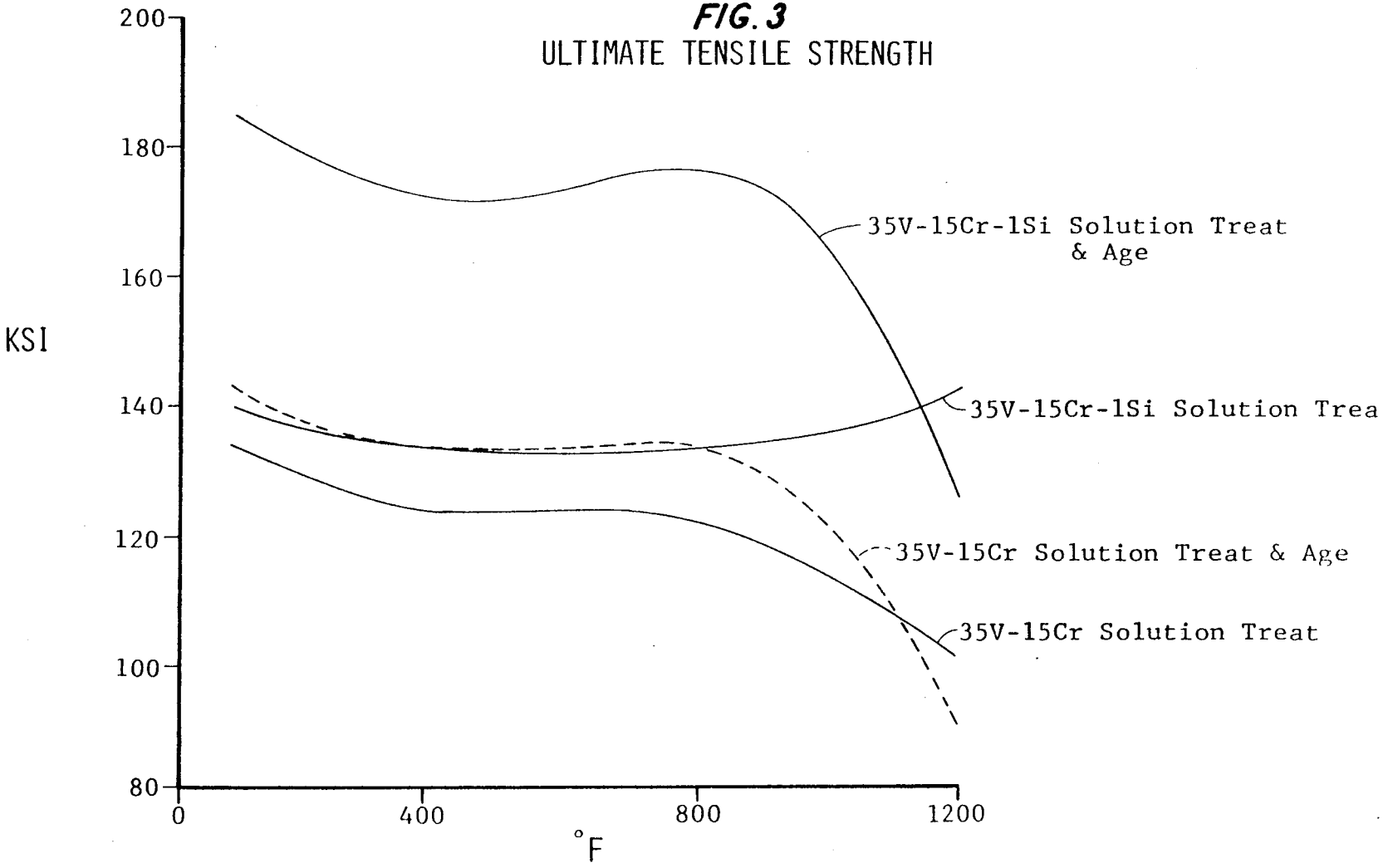
FIG. 3 is an 2000° F. ternary diagram of the Ti-V-Cr system.

The alloys of the present invention are based on the titanium-vanadium-chromium system and comprises the region bounded by points A, B, and C as shown in FIG. 1 which is a 600° F. phase diagram. FIG. 2 shows the same compositional triangle on the same ternary diagram at 1100° F. which also shows the approximate location of the boundary between the beta and beta plus gamma phases, where gamma is $TiCr_2$, and shows a dotted line which is the approximate location of a melting point trough. The shaded portion of the triangle in FIG. 1 (the portion bounded by points D, E and F) is the preferred composition for the present invention. FIG. 3 is the same ternary diagram at 2000° F.

The location of the beta-beta plus gamma phase boundary is not precisely known. Nor is the exact position of the melting point trough known and of course the position of these compositional boundaries will change if other alloying elements are added. For this reason a broad alternate description of the preferred invention composition is that it is a beta phase titanium alloy essentially free from the alpha phase and $TiCr_2$, (although minor amounts of these phases in nondeleterious quantity of about 3% may be tolerated), containing more than 10% chromium (e.g., 13-36), more than about 20% vanadium (e.g., 22-40%) and more than about 40% titanium (e.g., balance) located on the titanium rich side of the low melting point trough and on the vanadium rich side of the beta-beta plus gamma phase boundary. The reason for limiting the preferred composition to that being on one side of the beta-beta plus gamma phase boundary is that the presence of any substantial (e.g., 3% by volume) amount of the gamma ($TiCr_2$) or alpha phase would be detrimental to alloy mechanical properties, especially ductility. It is postulated (and preliminarily confirmed by experiment) that other detrimental phases will form on the other side of the low melting phase trough and for this reason the invention composition is restricted to be on the titanium rich side of that trough. Finally and very importantly, the alloys must to contain more than about 10% chromium (with the amount of chromium present being sufficient to prevent combustion in the previously described test) since about 13% chromium has been found to provide substantially nonburning characteristics in the base alloys, and preferably at 13% chromium is present.

Figure 4:
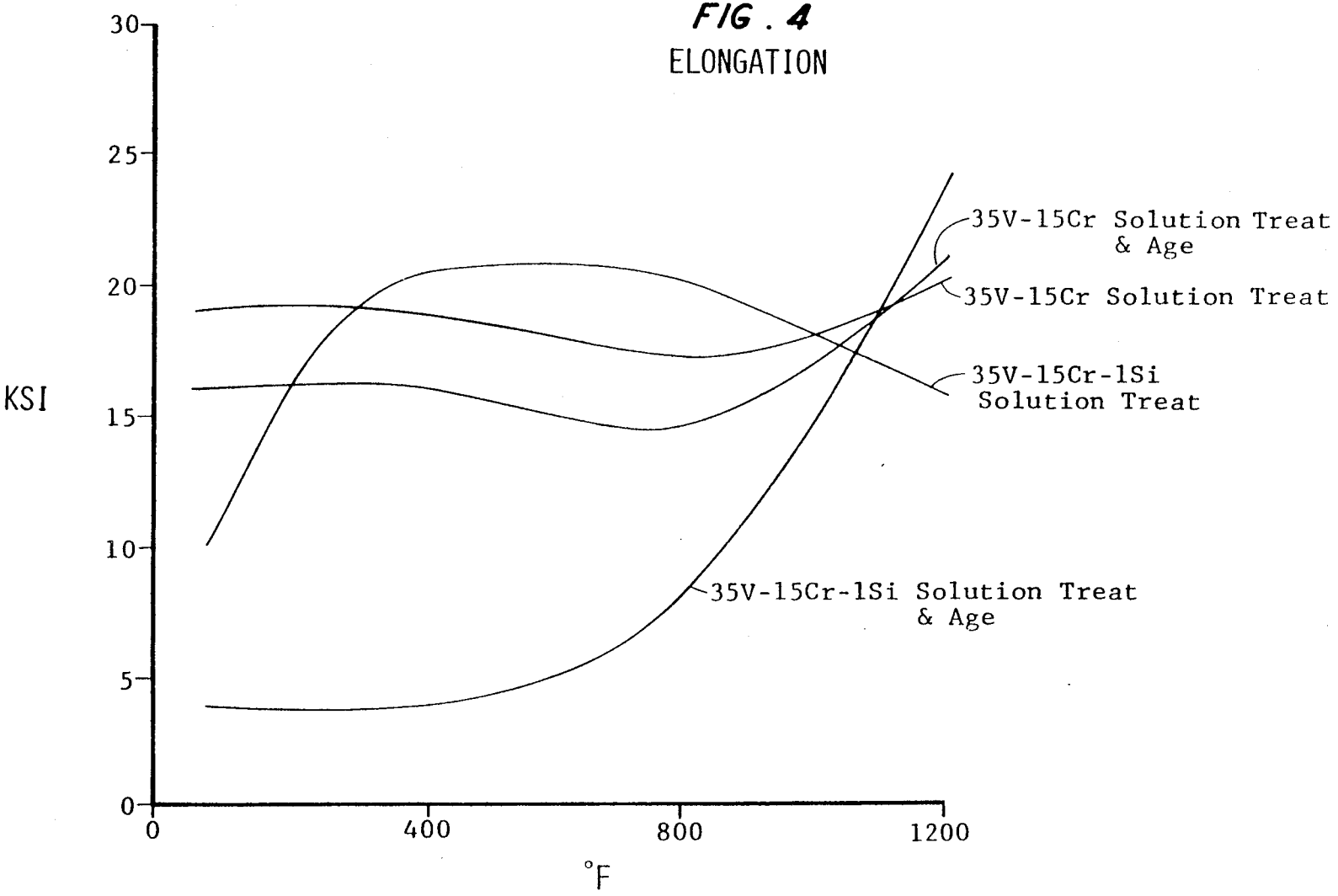
FIG. 4 shows the 0.1% creep behavior of an invention alloy (Ti-35% V-15 Cr-0.15%C).

The alloys are strong at elevated temperatures as illustrated in FIG. 4 which is a Larson Miller plot showing the creep behavior of a commercial alloy known as Ti-6-2-4-2 (6% Al, 2% Sn, 4% Zr, 2% Mo, balance Ti) which is the strongest most creep resistant commercially available titanium alloy. The Larson Miller Parameter (LMP) is widely used in presenting creep data and is defined as $LMP = T_a(C + \text{Log } t) \times 10^{-3}$ where $T_a$ is the absolute temperature, C is a constant which is usually 20 and "t" is time required to undergo particular amount of creep.

Thus for example according to the figure, at constant conditions described by LMP=31, the prior art alloy could withstand 45 ksi while the invention alloy could withstand 65 ksi. At a constant stress of 50 ksi the prior art material would exhibit a LMP of 30.5 which the invention material was strong enough to withstand conditions equivalent to a LMP of 32.4.

The significance of a LMP of 32.4 verses a LMP of 30.5 are as follows: at a constant stress of 50 ksi at 1000° F. the prior art material would creep 0.1% in 7.8 hours while the invention material would creep 0.1% in 155.5 hours, almost 20 times longer. Alternatively, at 50 ksi the prior art material could withstand about 926° F. for 100 hours (before creeping 0.1%) while the invention material could withstand 1012° F. for the same 100 hours (before creeping 0.1%), a temperature advantage of about 86° F. Thus in creep the invention material is distinctly superior to the standard prior art material.

Conventional high strength titanium alloys, such as Ti-6-2-4-2, have a different crystal structure and exhibit differently shaped creep curves than that of the invention material. Thus the invention material is notably superior in 0.1% and 0.2% creep to Ti-6-2-4-2 but basically equivalent at 0.5%, 1% and in creep rupture. For many gas turbine applications creep must be minimized and the 0.1% and 0.2% values are most significant.

The effect of chromium on the burnability of this class of alloys is shown in Table I. From Table I it seems that chromium in an amount of about 13% is required to produce an alloy which is nonburnable according to the previously setout test which simulates compressor section of the gas turbine engine.

As noted previously, most if not all additional (quaternary) alloying elements will change the position of the beta-beta plus alpha phase boundary, the melting point trough and the exact amount of chromium necessary for nonflammability on the alloy. It is clearly within the scope of the skilled artisan to use metallographic techniques to ascertain whether any alpha phase is present and to use the previously described flammability test to determine whether sufficient chromium is present.

It is comtemplated that up to about 10% by volume of nonbeta, nonalpha, non$TiCr_2$, nondeleterious phases may be present for purposes related to property improvements.

Figure 5:
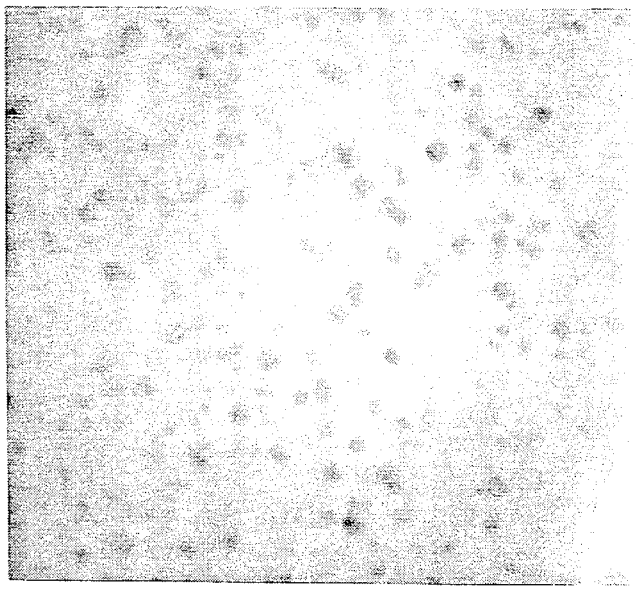
FIG. 5 shows tensile data as a function of temperature for an alloy according to the invention (Ti-35% V-15% Cr).

FIG. 5 shows tensile properties, ultimate tensile strength, and 0.2% yield strength, of the previously described commercial titanium alloy and of the Ti-35% vanadium-15% chromium alloy according to the present invention. The properties of the invention alloy are superior to those of the commercial alloy for most temperatures with the degree of superiority increasing with temperature—this is consistant with the previously described creep results. The reduction in area and elongation for the invention material was somewhat less than those for the commercial alloy.

The properties of the invention material are exceptional but there is every reason to believe that these properties can be further improved by the addition of relatively small amounts of alloying elements. Table II sets out a list of prospective quaternary alloying elements and their proposed range. Evidence exists that cobalt, chromium, copper, iron, manganese, molybdenum, nickel, silicon and gallium will all aid in increasing the resistance to burning of these alloys. Boron, beryllium, chromium, niobium, rhenium, silicon, tin and bismuth are all believed to have the potential to increase the oxidation resistance of the material. Boron, beryllium, carbon, cobalt, iron, manganese, molybdenum, niobium, nickel, oxygen, silicon, tin, tantalum, vanadium, tungsten, zirconium, gallium and hafnium all have the potential to increase the mechanical properties of the material.

In particular carbon has been demonstrated to improve the post-creep ductilitiy of the alloy without adversely affecting the room temperature tensile ductility.

Tables III, IV, V and VI tabulate available data on tensile properties of various alloys according to the invention and illustrates the effect of some alloying elements on mechanical properties.

The addition of carbon in amounts in excess of about 0.05% results in formation of carbides. Normally carbide phases are quite hard and strong but have little ductility. However in this alloy system the carbides are relatively ductile and do not fracture during forging. Another interesting aspect relating to carbon in the low reactivity of the metal (in molten form) with carbon, in marked contrast to the extensive reactions observed between conventional alloys and carbon. This suggests the potential of melting in graphite crucibles and casting in graphite molds, practices which could revolutionize this titanium industry. In addition, preliminary indications are that this invention alloys can be successfully cast in ceramic shell molds which are widely used in the investment casting of nickel and cobalt superalloys.

When carbon is present, the strong carbide forming alloying elements hafnium etc. can advantageously be added to form controlled composition carbide phases.

The invention compositions may be fabricated using conventional titanium metallurgy technology such as Vacuum Arc Remelting and skull melting techniques. The relatively low reactivity of the invention material may permit use of alternative less costly technology.

Although this invention has been shown and described with respect to detailed embodiments thereof, it will be understood by those skilled in the art that various changes in form and detail thereof may be made without departing from the spirit and scope of the claimed invention.

TABLE I

| Alloy Ti | V | Cr | Other | Result |
|---|---|---|---|---|
| | | Burn Test Results | | |
| Bal | 13 | 11 | 3 Al | Burns |
| Bal | 35 | 15 | — | Nonburning |
| Bal | 25 | 15 | — | " |
| Bal | 30 | 15 | — | " |
| Bal | 25 | 35 | — | " |
| Bal | 35 | 15 | 0.5 Hf | " |
| Bal | 35 | 15 | 2 Si | " |
| Bal | 30 | 15 | 5 Cb | " |
| Bal | 35 | 15 | 4 Zr | " |
| Bal | 35 | 15 | 2 Mo | " |
| Bal | 35 | 15 | 3 Fe | " |
| Bal | 35 | 15 | 2 Co | " |
| Bal | 35 | 15 | 4 Co | " |
| Bal | 35 | 15 | 6 Co | " |
| Bal | 35 | 15 | 1 Ru | " |
| Bal | 35 | 15 | 3 Ru | " |
| Commercial Alloys Ti-6-4, Ti 6-2-4-2, etc. | | | | All Burn |

TABLE II

| | Broad | Preferred |
|---|---|---|
| B | 0-0.6 | 0.1-0.5 |
| Be | 0-4.0 | 0.1-3.0 |
| C | 0-2.5 | 0.01-2.0 |
| Co | 0-7.0 | 0.5-6.0 |
| Cr | 0-7.0 | 0.5-6.0 |
| Fe | 0-4.0 | 0.5-3.0 |
| Mn | 0-7.0 | 0.5-5.0 |
| Mo | 0-12 | 0.5-10.0 |
| Nb | 0-12 | 0.5-10.0 |
| Ni | 0-12 | 0.5-10.0 |
| O | 0-0.3 | 0.08-0.2 |
| Re | 0-1.5 | 0.01-1.0 |
| Si | 0-2.5 | 0.01-2.0 |

TABLE II-continued

| | Broad | Preferred |
|---|---|---|
| Sn | 0-2.5 | 0.1-2.0 |
| Ta | 0-1.5 | 0.1-1.0 |
| W | 0-2.5 | 0.5-2.0 |
| Zr | 0-5.0 | 0.5-4.0 |
| Bi | 0-1.5 | 0.1-1.0 |
| Ga | 0-2.5 | 0.1-2.0 |
| Hf | 0-1.5 | 0.1-1.0 |

TABLE III

| Alloys | .2% Y.S. | UTS | % El | % RA | Prior H.T. |
|---|---|---|---|---|---|
| | Room Temperature Tensile Tests | | | | |
| Ti-35V-15Cr | 152.1 | 167.1 | 17.0 | 14.3 | 1700°/4 hr |
| " | 132.5 | 134.9 | 21.5 | 24.4 | — |
| " | 131.3 | 131.9 | 18.5 | 24.4 | — |
| Ti-35V-15Cr-0.15C | 125.8 | 127.7 | 12.0 | 23.0 | — |
| " | 130.9 | 134.1 | 19.0 | 33.3 | — |
| " | 129.9 | 134.6 | 17.5 | 29.8 | — |
| " | 128.5 | 133.6 | 17.0 | 34.4 | — |
| Ti-35V-15Cr-0.625C | 171.4 | 184.1 | 5.3 | 7.6 | 1400°/4 hr |
| Ti-30V-15Cr-0.5Hf-0.75C | 145.1 | 167.2 | 13.5 | 25.8 | 1750°/4 hr |
| Ti-25V-35Cr-5Al | 172.8 | 172.8 | 1.3 | 0.5 | 2050°/4 hr |
| Ti-6-2-4-2 | 130.0 | 150.0 | 14.0 | 25.0 | — |

TABLE IV

| Alloys | .2% Y.S. | UTS | % El | % RA | Prior H.T. |
|---|---|---|---|---|---|
| | 800° F. Tensile Tests | | | | |
| Ti-35V-15Cr | 93.6 | 119.4 | 15.5 | 33.5 | — |
| " | 94.5 | 120.4 | 18.0 | 33.7 | — |
| Ti-35V-15Cr-0.15C | 95.3 | 118.7 | 6.9 | 15.2 | — |
| " | 94.2 | 119.8 | 9.3 | 18.2 | — |
| " | 95.8 | 122.3 | 16.5 | 30.4 | — |
| Ti-35V-15Cr-0.625C | 141.2 | 152.5 | 2.7 | 5.9 | 1400°/4 hr |
| Ti-35V-15Cr-0.436C | 140.9 | 152.4 | 2.0 | 2.7 | 1400°/4 hr |
| Ti-30V-15Cr-0.627C | 121.6 | 156.3 | 8.5 | 14.5 | — |
| Ti-35V-15Cr-2Si | 145.7 | 156.1 | 1.0 | 1.2 | 2050°/4 hr |
| Ti-33.5V-15.5Cr-3.6Cb | 119.6 | 160.1 | 17.0 | 32.1 | 2150°/4 hr |
| Ti-25V-35Cr-5Al | 129.7 | 159.9 | 17.0 | 20.2 | 1700°/4 hr |
| Ti-35V-15Cr-2Si | 145.2 | 166.3 | 2.0 | 1.6 | 2050°/4 hr |
| Ti-35V-15Cr-0.5Hf-0.75C | 128.4 | 166.5 | 8.7 | 9.4 | — |
| " | 122.5 | 160.8 | 9.5 | 13.4 | 1750°/4 hr |
| Ti-6-2-4-2 | 84.0 | 108.0 | 14.0 | 38.0 | — |

TABLE V

| Alloys | .2% Y.S. | UTS | % El | % RA | Prior H.T. |
|---|---|---|---|---|---|
| | 1200° F. Tensile Tests | | | | |
| Ti-35V-15Cr | 91.2 | 103.0 | 6.5 | 13.8 | — |
| " | 93.7 | 107.2 | 6.0 | 11.2 | — |
| Ti-35V-15Cr-0.15C | 94.4 | 106.6 | 5.4 | 13.0 | — |
| " | 89.8 | 100.3 | 20.0 | 37.1 | — |
| " | 99.1 | 100.4 | 23.0 | 36.3 | — |
| Ti-35V-15Cr-0.625C | 73.7 | 72.7 | <1.0 | <1.0 | 1400°/4 hr |
| Ti-35V-15Cr-2Si | 125.0 | 137.7 | 1.5 | 4.3 | — |
| Ti-33.5V-15.5Cr-2.6Cb | 109.2 | 127.9 | 13.5 | 22.3 | 2150°/4 hr |
| Ti-30V-15Cr-0.5Hf-0.75C | 97.2 | 112.7 | 12.5 | 18.1 | 1750°/4 hr |
| Ti-6-2-4-2 | 60.0* | 65.0* | 38.0* | 75.0* | — |

*Extrapolated Values

TABLE VI

| | 1200° F. Tensile Tests | | | | |
|---|---|---|---|---|---|
| Alloys | .2% Y.S. | UTS | % El | % RA | Prior H.T. |
| Ti-35V-15Cr | 54.7 | 55.9 | 20.0 | 19.6 | — |
| Ti-35V-15Cr-0.15C | 48.8 | 55.9 | 90.9 | 90.1 | — |
| Ti-6-2-4-2 | | Data Not Available | | | |

I claim:

1. A true beta phase titanium alloy useful at temperatures up to at least 1200° F. which comprises: more than about 10% Cr (sufficient to render the alloy nonburing), more than about 20%V, and more than about 40% Ti and having the following characteristics;

a. substantial freedom from the alpha and $TiCr_2$ phases;

b. noncombustibility as evaluated by the test described herein;

c. an 800° F. 0.2% yield strength in excess of about 80 ksi; and d. a 0.1% creep life at 1000° F. and 50 ksi in excess of 100 hours.

2. A true beta phase titanium alloy which comprises:

greater than about 10% Cr
greater than about 20% V
up to about 0.6% B
up to about 4% Be
up to about 2.5% C
up to about 7% Co
up to about 4% Fe
up to about 7% Mn
up to about 12% Mo
up to about 12% Nb
up to about 12% Ni
up to about 0.3% O
up to about 1.5% Re
up to about 2.5% Si
up to about 2.5% Sn
up to about 1.5% Ta
up to about 2.5% W
up to about 5% Zr
up to about 1.5% Bi
up to about 2.5% Ga
up to about 1.5% Hf balance essentially Ti in amount of at least 40%, said alloy containing less than 3% by volume alpha, 3% by volume $TiCr_2$ and 10% of other nonbeta phases.

3. A true beta phase titanium alloy containing at least 10% Cr, at least 20% V and at least 40% Ti said alloy lying on the tanium rich side of the low melting trough (shown in FIG. 1) and on the vanadium rich side of the beta-beta plus gamma phase boundary shown in FIG. 1 and containing sufficient Cr to be nonburning.

* * * * *